United States Patent [19]

Pearl

[11] 4,364,330

[45] Dec. 21, 1982

[54] CUTTING APPARATUS WITH CONSUMABLE MARKER

[75] Inventor: David R. Pearl, West Hartford, Conn.

[73] Assignee: Gerber Garment Technology, Inc., South Windsor, Conn.

[21] Appl. No.: 272,961

[22] Filed: Jun. 12, 1981

[51] Int. Cl.[3] ..... B05C 9/02

[52] U.S. Cl. ..... 118/697; 118/37; 118/76

[58] Field of Search ..... 118/696, 697, 37, 38, 118/76, 77

[56] References Cited

U.S. PATENT DOCUMENTS

| | | | |
|---|---|---|---|
| 2,807,236 | 9/1957 | Wolf | 118/76 |
| 3,939,482 | 2/1976 | Cotter | 118/76 X |
| 4,132,190 | 1/1979 | Stahl | 118/76 |
| 4,261,285 | 4/1981 | Pearl | 118/37 |

*Primary Examiner*—John P. McIntosh

*Attorney, Agent, or Firm*—McCormick, Paulding & Huber

[57] ABSTRACT

An automatically controlled machine for cutting single plies of limp sheet material employs a cutting wheel and a hard, smooth and continuous support surface on which the sheet material is spread for cutting. The machine is controlled by a program to move the cutting wheel along predetermined cutting paths that define pattern pieces for clothing, upholstery and similar products. The machine has a rotatable marking tool that includes a consumable shaft of marking matter such as chalk. The shaft is translated over the sheet material cut by the machine and is lowered into engagement with the material at desired locations to generate nonpermanent marks for positional reference in subsequent cutting, sewing or other finishing operations.

6 Claims, 4 Drawing Figures

CUTTING APPARATUS WITH CONSUMABLE MARKER

BACKGROUND OF THE INVENTION

The present invention relates to automatically controlled cutting machines that cut limp sheet material for garments, upholstery and the like. In particular, the invention is concerned with apparatus for marking pattern pieces cut from the limp sheet material for positional reference in subsequent finishing operations.

It is customary in the garment industry to cut pattern pieces from limp sheet material spread on a cutting table and, while the pieces are still on the table, to mark the pattern pieces at predetermined locations for the purpose of identifying junctions with adjacent pattern pieces, seams, button holes, pockets and other locations that are critical to assembly and attachment of the pattern pieces in a finished product. Similar procedures are followed with items of upholstery, shoes, sails and numerous other products that are made from a plurality of pattern pieces cut from limp sheet material.

The marking systems used in the past performed the marking function by notching the edge of a pattern piece as described in U.S. Pat. No. 3,626,799, drilling the sheet material as described in U.S. Pat. No. 3,730,634 or depositing a visible substance at identified locations of the pattern pieces as described in U.S. Pat. No. 3,731,648 and 3,991,706, all having the same assignee as the present invention. In prior art cutting machines, multiple layers of sheet material are cut simultaneously in a layup, and the marking devices are designed to produce marks on each ply while the plies are stacked in the layup on the cutting table.

In a cutting machine such as described in U.S. patent application 168,312, filed July 10, 1980 by the assignee, which machines is designed to cut pattern pieces from a single ply of sheet material, a different type of marking apparatus can be employed since there is no necessity for penetrating through multiple plies of material to produce marks on each ply.

It is, accordingly, a general object of the present invention to disclose an apparatus for placing marks at specified locations on pattern pieces cut from limp sheet material in automated single ply cutters.

SUMMARY OF THE INVENTION

The present invention resides in an apparatus for cutting limp sheet material positioned on a support surface and including an automatically controlled cutting tool for cutting the sheet material. Carriage means are provided for controllably moving the cutting tool and the sheet material on the surface relative to one another so that the tool may cut the material along a desired cutting path.

The improvement of the present invention comprises a rotatable marking tool that is suspended from the carriage means for movement with the cutting tool over the support surface and the material spread on the surface. The marking tool includes a consumable shaft of marking matter, such as a shaft of chalk, and has a depending end located adjacent the sheet material.

Motor means are connected with the marking tool for rotating the consumable shaft about the shaft axis, and actuating means are connected with the tool for moving the depending end of the consumable shaft into engagement with the sheet material on the support surface. Thus, when the shaft is rotated by the motor means and the depending end is placed in contact with the sheet material, a portion of the matter composing the shaft is deposited on the material at a given location.

With the marking tool suspended from the same carriage as the cutting tool, the marking operation can be carried out by positioning the carriage with the same automatic controls that position the cutting tool in a cutting operation. The use of the consumable shaft of marking matter produces no holes through the sheet material as in prior art drills or injecting equipment, and with marking matter such as chalk, the sheet material is not permanently marred.

DESCRIPTION OF THE PREFERRED EMBODIMENT

Figure 1:
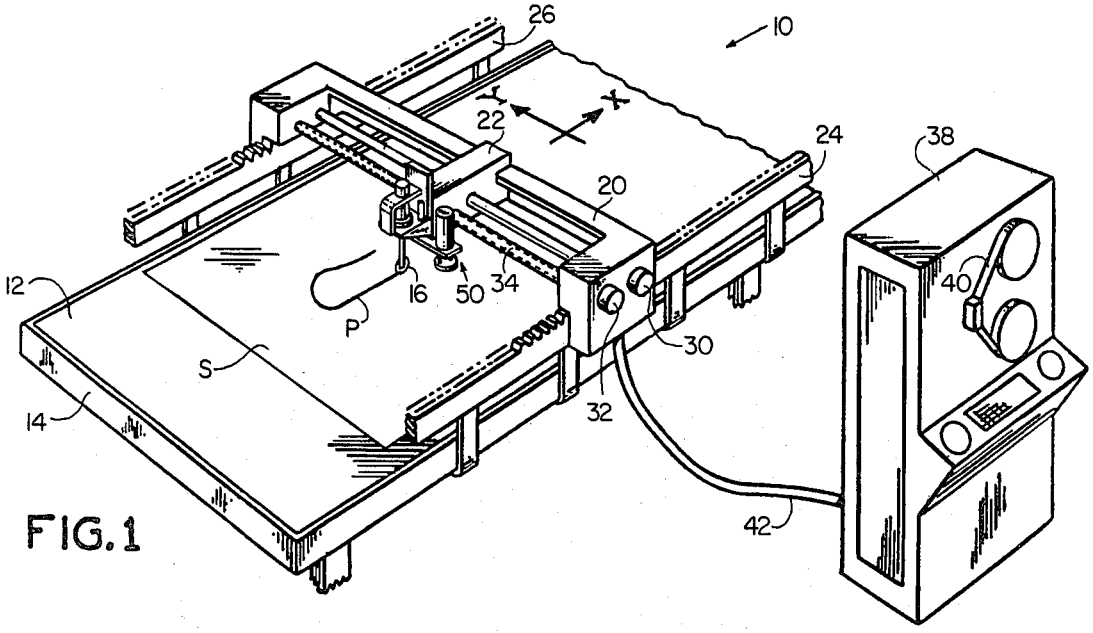
FIG. 1 is perspective view illustrating an automatically controlled cutting machine in which the marking tool of the present invention is employed.

FIG. 1 illustrates an automatically controlled cutting machine generally designated 10. The machine is used to cut single plies of limp sheet material such as cloth, plastic, paper cardboard, fiber reinforced composites, leather and similar materials. The sheet material S is positioned on a hard, stationary support surface 12 of a cutting table 14. The support surface is generally defined by the upwardly facing surface of a metal or hard plastic plate that forms the bed of the table 14. The sheet material S is spread and held in a flat position on the support surface 12 by a pressure sensitive adhesive or other means disclosed in copending application Ser. No. 168,312 referenced above.

A rotary cutting wheel 16 having a sharp peripheral cutting edge serves as the cutting tool for the machine 10. During a cutting operation, the wheel is pressed downwardly into engagement with the sheet material and the hard support surface beneath, and is translated along a desired cutting path P to cut pattern pieces or other objects from the sheet material S. For this purpose, the cutting wheel is mounted for movement relative to the table 14 by means of an X-carriage 20 which moves over the table in the illustrated X-coordinate direction and a Y-carriage 22 that is mounted on the X-carriage and moves relative to the carriage and table in the illustrated Y-coordinate direction. The X-carriage is mounted on a set of racks 24, 26 at each side of the table and an X-drive motor 30 is engaged by pinions (not shown) with each of the racks to produce driving forces for the carriage 20. The Y-carriage 22 is translated relative to the X-carriage 20 by means of a Y-drive motor 32 and a lead screw 34 engaged with the carriage 22. A further motor not shown orients the cutting wheel about an axis perpendicular to the surface 12 for alignment with the cutting path P at each point. Thus, the cutting wheel 16 can be translated over the table in any desired direction in cutting engagement with the sheet material S.

The drive motors 30 and 32 are energized by means of an automatic controller 38 which generates command signals for the cutting machine in accordance with a cutting program defined on a program tape 40. The command signals are transmitted through a cable 42 to the cutting table and the drive motors, and feedback signals from the table are returned through the cable to the controller.

In accordance with the present invention, a marking tool, generally designated 50, is connected to the Y-carriage 22 for translation over the support surface 12 to various locations on the sheet material S where marks are desired.

Figure 3:
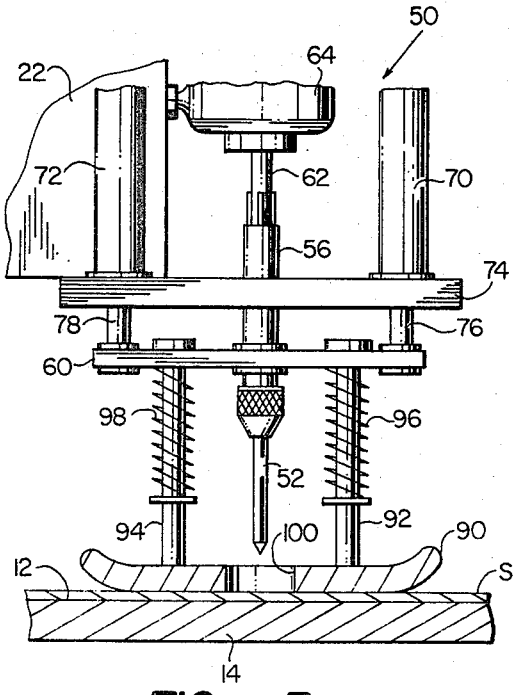
FIG. 3 is a fragmentary side elevation view of the marking tool partially actuated during a marking operation.
Figure 4:
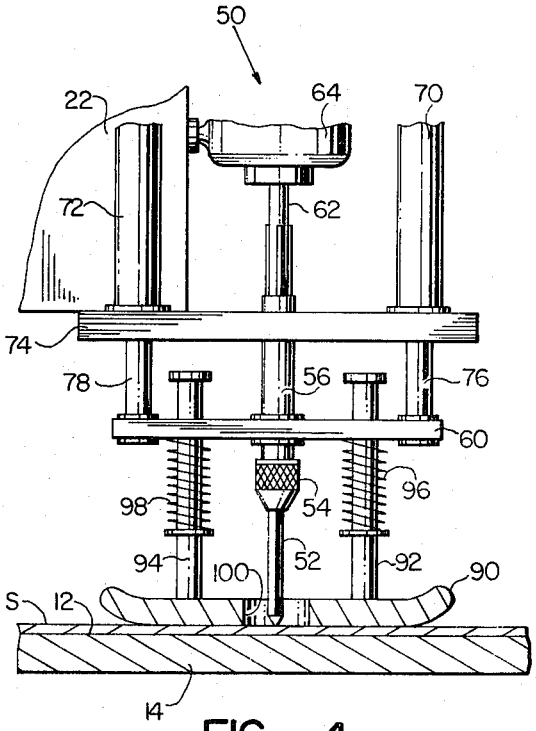
FIG. 4 is a fragmentary elevation view of the marking tool in the fully actuated position during a marking operation.
Figure 2:
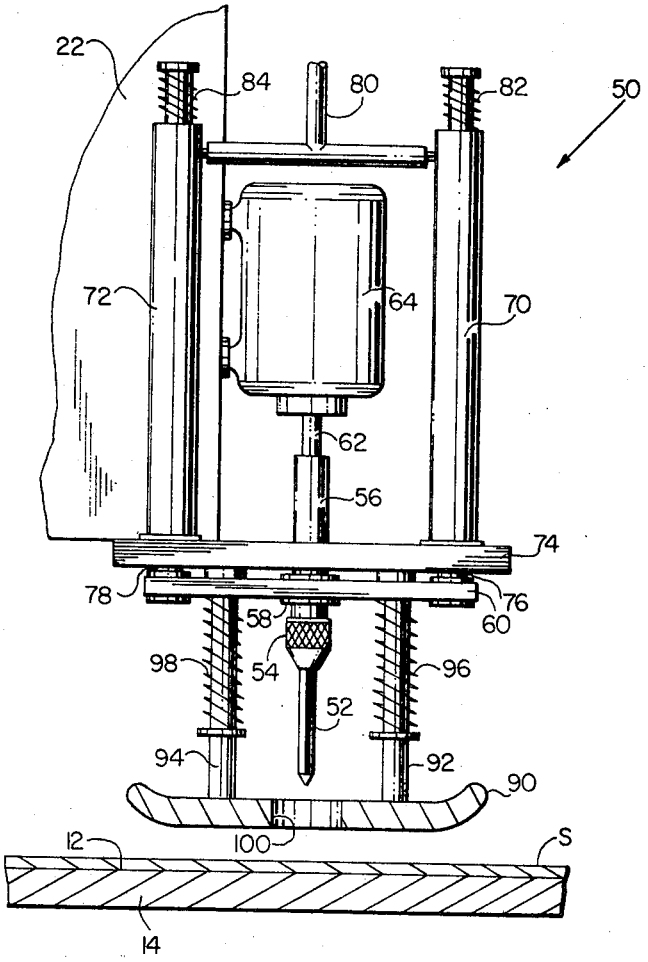
FIG. 2 is a side elevation view of the marking tool connected to one side of the cutting head carriage, and shows the marking tool in an elevated, non-actuated position.

The marking tool 50 is illustrated in greater detail in FIGS. 2–4. The tool employs a shaft 52 of consumable marking matter that is suspended from the Y-carriage 22 and produces a mark on the sheet material S when the shaft and material are placed in contact with one another. Various types of matter may comprise the shaft 52, but in a preferred embodiment, the matter is chalk that may be rubbed against the sheet material without producing a permanent or indelible mark. Ideally, the chalk would have a fluorescent dye so that the marks produced on the sheet material would be readily observed in a fluorescent light commonly employed in sewing rooms where a number of cut pattern pieces are assembled in a finished product.

As shown in FIG. 2, the consumable marking shaft 52 is held in a releasable chuck 54 for rotation about the longitudinal axis of the shaft. The chuck in turn is fastened to an internally splined drive tube 56 which is journalled by bearings 58 in a platform 60 that moves vertically toward and away from the support surface 12 of the cutting table 14. The drive tube is connected through a splined shaft 62 to a drive motor 64 which is fixedly secured to the side of the cutting carriage 22. Thus, as the platform 60 moves toward and away from the support surface 12, the splines interconnecting the tube 56 and the shaft 62 allow the consumable marking shaft 52 to be rotated by the drive motor at each elevation.

A pair of pneumatic actuators 70, 72 are mounted on a stationary platform 74 at the lower edge of the Y-carriage 22. The actuators are piston and cylinder assemblies in which the cylinders are secured to the stationary platform 74 and extendable piston rods 76, 78 in the respective actuators are connected with the movable platform 60. Each of the actuators 70, 72 is supplied with air through the common conduit 80 at the upper end of the cylinders, and when air is supplied to the cylinders, the piston rods extend and lower the platform 60 toward the support surface 12 as shown in the sequence of FIGS. 2, 3 and 4. Return springs 82, 84 shown in FIG. 2 are mounted coaxially about the respective piston rods between the upper ends of the rods and the upper ends of the cylinders, and are compressed by the downward displacement of the rods and the movable platform 60 when air pressure is applied to the actuators. Correspondingly, when air pressure is released from the actuators, the return springs 82, 84 lift the platform 60 upwardly away from the support surface 12 of the table to the position adjacent the stationary platform 74 as shown in FIG. 2. Consequently, by controlling the air pressure in the actuators 70, 72, the movable platform 60, together with the consumable shaft 52 of marking matter, is lowered and raised relative to the cutting table 14.

A presser foot 90 is resiliently suspended from the movable platform 60 by means of rods 92, 94 that are slidably received in the platform 60 and compression springs 96, 98 that are mounted coaxially about the respective rods 92, 94. In the elevated position of the platform, the springs hold the presser foot 90 extended downwardly below the depending end of the consumable marking shaft 52 as shown in FIG. 2. When the platform 60 is lowered by the actuators 70, 72, the presser foot 90 makes contact with the sheet material S well before the depending end of the shaft 52 as shown in FIG. 3. As the platform 60 continues to move downwardly to the position shown in FIG. 4 which places the shaft 52 into contact with the sheet material, the springs 96, 98 are progressively compressed and increase the pressure applied by the presser foot to the sheet material on the support surface 12. In this manner, the presser foot 90 insures that the sheet material is held in a fixed position for marking.

When the platform 60 is lowered to the position shown in FIG. 4, the depending end of the consumable marking shaft 52 passes through a central aperture 100 in the presser foot 90 and makes contact with the sheet material S. Preferably the drive motor 64 is energized to rotate the marking shaft 52 prior to the establishment of contact between the shaft and the sheet material so that momentary contact is sufficient to rub some of the matter onto the sheet material and produce a reference mark at the position over which the marking tool 50 is located. It will be understood that since the marking tool 50 is mounted to the Y-carriage 22, the same controls which position the cutting wheel 16 (FIG. 1) are also used to locate the marking tool. The offset relationship of the cutting wheel and the marking tool on the Y-carriage is fixed and is automatically accounted for by the controller 38 when marking operations are carried out. Such operations may be performed before or after the cutting operations.

While the marking shaft 52 is rotated in engagement with the sheet material during a marking operation, the depending end of the shaft is pressed into engagement with the material under a slight pressure determined by the forces produced on the movable platform 60 by the actuators 70, 72 and the compression springs 96, 98. Twisting forces applied to the material by the rotating shaft are resisted by the presser foot 90 which surrounds the depending end of the shaft in adjacent relationship. Friction associated with the rubbing of the rotating shaft against the material deposits some of the marking matter on the material, and at the same time, consumes or wears away a small portion of the chalk or other matter from which the shaft is formed. In subsequent marking operations, the return springs 82, 84 at the upper end of the actuators 70, 72, together with the compression springs 96, 98, provide the necessary compliance to allow the actuators to move the platform 60 to lower elevations at substantially uniform pressure levels and compensate for the wear at the lower end of the shaft. When a substantial portion of the shaft has been consumed by many marking operations, the shaft can be removed from the chuck 54, and be replaced by a new shaft.

At the end of a marking operation, pressure is released from the actuators 70, 72, and both the presser foot 90 and the marking shaft 52 return to the elevated position as shown in FIG. 2. In this position, cutting may be continued or the marking tool may be moved to other locations over the sheet material S to produce marks as needed.

Accordingly, an automatically controlled cutting machine has been disclosed above with a marking tool for generating localized marks on the sheet material being cut for future notation and reference. The tool is comprised by a consumable shaft of marking matter and automatically compensates for any wear on the shaft incurred by repeated marking operations.

While the present invention has been described in a preferred embodiment, it should be understood that numerous modifications and substitutions can be had without departing from the spirit of the invention. For example, adjustable limit stops may be provided to more accurately control the lowering of the marking shaft and the pressure produced between the shaft and the sheet material during each marking operation. The stops can be adjusted by finite amounts between each marking operation to compensate for wear at the depending end of the shaft. The presser foot may be suspended and actuated into engagement with the sheet material independently of the marking tool so that the progressive wear on the marking shaft has no influence on the holding pressure of the foot. Alternatively, the presser foot may be eliminated as long as the sheet material is held on the support surface 12 by other means or is self-restraining. In this event or if the foot is independently controlled, the marking tool may be used not only to produce spot-type marks but also to annotate the sheet material with more definitive information. The consumable shaft may be comprised by many materials and encased in a dispenser or removable envelope. If it is desired to maintain a narrow point at the depending end of the shaft, the shaft may be periodically sharpened in a pencil sharpener or similar device when the point becomes dull. Accordingly, the present invention has been described in a preferred embodiment by way of illustration rather than limitation.

I claim:

1. In combination in an apparatus for cutting limp sheet material positioned on a support surface and including an automatically controlled cutting tool for cutting the sheet material and carriage means for controllably moving the cutting tool and the material on the support surface relative to one another along a desired cutting path, the improvement comprising: a rotatable marking tool suspended from the carriage means for movement with the cutting tool over the support surface and the sheet material on the surface, the marking tool including a consumable shaft of marking matter having a depending end located adjacent the sheet material, drive motor means connected in driving relationship with the marking tool for rotating the consumable shaft about the axis of the shaft and marking the exposed surface of the sheet material while the depending end is engaged with the limp sheet material, and actuating means connected with the tool for moving the depending end of the consumable shaft into engagement with the sheet material on the support surface whereby motor driven rotation of the shaft about the shaft axis abrasively deposits some of the marking matter on the material.

2. In combination in an apparatus for cutting limp sheet material, the improvement of claim 1 wherein the consumable shaft of marking matter is comprised by a marking matter that is not permanently adhering to the sheet material.

3. In combination in an apparatus for cutting limp sheet material, the improvement of claim 1 wherein the consumable shaft of marking matter is chalk.

4. In combination in an apparatus for cutting limp sheet material, the improvement of claim 1 further including means mounted to the carriage means adjacent the rotatable marking tool for pressing the limp sheet material in stationary relationship against the support surface during marking.

5. In combination in an apparatus for cutting limp sheet material, the improvement of claim 4 wherein the means for pressing comprises a presser foot resiliently supported from the carriage means in coaxial relationship with the consumable shaft of marking matter.

6. In the combination of claim 4, the improvement wherein the pressing means includes a resilient support and a foot suspended by the support from the carriage means, the resilient support having a suspended condition placing the foot closer to the support surface than the depending end of the consumable shaft; and the actuating means is also connected with the resilient support and the foot for moving the foot toward the sheet material simultaneously with the consumable shaft of marking matter whereby the closer positioning of the foot and the material brings the foot into engagement with the sheet material on the support surface before the depending end of the shaft to restrain the material movement during marking.

* * * * *